US008168944B2

(12) United States Patent
Guna

(10) Patent No.: US 8,168,944 B2
(45) Date of Patent: May 1, 2012

(54) METHODS AND SYSTEMS FOR PROVIDING A SUBSTANTIALLY QUADRUPOLE FIELD WITH A HIGHER ORDER COMPONENT

(75) Inventor: Mircea Guna, Toronto (CA)

(73) Assignee: DH Technologies Development Pte. Ltd., Singapore (SG)

( * ) Notice: Subject to any disclaimer, the term of this patent is extended or adjusted under 35 U.S.C. 154(b) by 122 days.

(21) Appl. No.: 12/830,384

(22) Filed: Jul. 5, 2010

(65) Prior Publication Data

US 2011/0155902 A1 Jun. 30, 2011

Related U.S. Application Data

(60) Provisional application No. 61/223,201, filed on Jul. 6, 2009.

(51) Int. Cl.
*H01J 49/42* (2006.01)
*H01J 49/26* (2006.01)

(52) U.S. Cl. ..... 250/282; 250/292; 250/281; 250/288; 250/290

(58) Field of Classification Search ..... 250/282, 250/292, 281, 288, 290
See application file for complete search history.

(56) References Cited

U.S. PATENT DOCUMENTS

| | | | | |
|---|---|---|---|---|
| 6,111,250 | A | 8/2000 | Thomson et al. | |
| 6,177,688 | B1 | 1/2001 | Linthicum et al. | |
| 6,831,275 | B2 | 12/2004 | Franzen et al. | |
| 6,897,438 | B2 * | 5/2005 | Soudakov et al. | 250/288 |
| 7,034,293 | B2 | 4/2006 | Wells | |
| 7,045,797 | B2 * | 5/2006 | Sudakov et al. | 250/292 |
| 7,141,789 | B2 * | 11/2006 | Douglas et al. | 250/292 |
| 7,541,579 | B2 * | 6/2009 | Konenkov et al. | 250/292 |
| 7,692,143 | B2 * | 4/2010 | Guna | 250/292 |
| 2004/0021072 | A1 | 2/2004 | Soudakov et al. | |
| 2005/0178963 | A1 | 8/2005 | Londry et al. | |
| 2006/0118716 | A1 | 6/2006 | Michaud et al. | |

OTHER PUBLICATIONS

F. A. Londry and James W. Hager, "Mass Selective Axial Injection from a Linear Quadrupole Ion Trap", Journal of the American Association of Mass Spectrometry, 2003, 1130-1147.
International Preliminary Report on Patentability in PCT/CA2010/001044 dated Jan. 10, 2012.

* cited by examiner

*Primary Examiner* — Nikita Wells
(74) *Attorney, Agent, or Firm* — Nutter McClennen & Fish LLP

(57) ABSTRACT

A two-dimensional substantially quadrupole field is provided. The field comprises a quadrupole harmonic of amplitude A2 and an octopole harmonic of amplitude A4, wherein A4 is greater than 0.01% of A2, A4 is less than 5% of A2, and, for any other higher order harmonic with amplitude An present in the field, n being any integer greater than 2 except 4, A4 is greater than ten times An.

27 Claims, 8 Drawing Sheets

METHODS AND SYSTEMS FOR PROVIDING A SUBSTANTIALLY QUADRUPOLE FIELD WITH A HIGHER ORDER COMPONENT

This is a non-provisional application of U.S. Application No. 61/223,201 filed Jul. 6, 2009. The contents of U.S. Application No. 61/223,201 are incorporated herein by reference.

FIELD

The present invention relates to methods and systems for providing an substantially quadrupole field with a higher order component.

INTRODUCTION

The performance of ion trap mass spectrometers can be limited by a number of different factors such as, for example, space charge density. Accordingly, improved mass spectrometer systems, as well as methods of operation, that address these limitations, are desirable.

SUMMARY

In accordance with an aspect of another embodiment of the present invention, there is provided a method of processing ions in a linear ion trap, the method comprising: a) establishing and maintaining a two-dimensional substantially quadrupole field, the field comprising a quadrupole harmonic of amplitude A2 and an octopole harmonic of amplitude A4, wherein A4 is greater than 0.01% of A2, A4 is less than 5% of A2, and, for any other higher order harmonic with amplitude An present in the field, n being any integer greater than 2 except 4, A4 is greater than ten times An; and, b) introducing ions to the field.

In accordance with an aspect of the embodiment of the present invention, there is provided linear ion trap system comprising: (a) a central axis; (b) a first pair of rods, wherein each rod in the first pair of rods is spaced from and extends alongside the central axis; (c) a second pair of rods, wherein each rod in the second pair of rods is spaced from and extends alongside the central axis; (d) four auxiliary electrodes interposed between the first pair of rods and the second pair of rods in an extraction region defined along at least part of a length of the first pair of rods and the second pair of rods, wherein the four auxiliary electrodes comprise a first pair of auxiliary electrodes and a second pair of auxiliary electrodes; and, (e) a voltage supply connected to the first pair of rods, the second pair of rods and the four auxiliary electrodes. The RF voltage supply is operable to provide i) a first RF voltage to the first pair of rods at a first frequency and in a first phase, ii) a dipolar excitation AC to either the first pair of rods or a diagonally oriented pair of auxiliary electrodes at a lower frequency than the first frequency to radially excite the selected portion of the ions having the selected m/z, iii) a second RF voltage to the second pair of rods at a second frequency equal to the first frequency and in a second phase, opposite to the first phase, and iv) an auxiliary RF voltage to the four auxiliary electrodes at an auxiliary frequency equal to the first frequency and substantially in the first phase, wherein the diagonally oriented pair of auxiliary electrodes are closer to the other auxiliary electrodes than to each other.

BRIEF DESCRIPTION OF THE DRAWINGS

A skilled person in the art will understand that the drawings, described below are for illustration purposes only. The drawings are not intended to limit the scope of the Applicant's teachings in any way.

DETAILED DESCRIPTION

Figure 1:
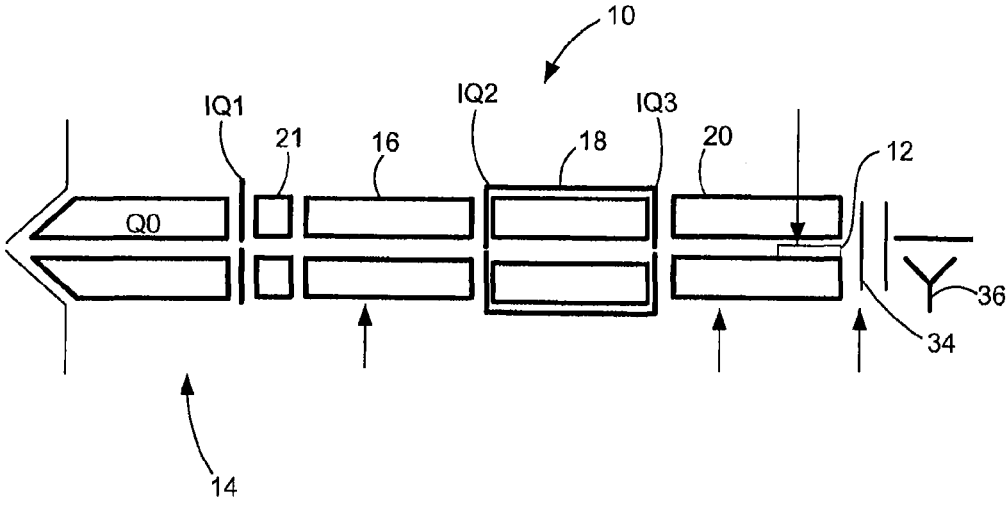
FIG. 1, in a schematic diagram, illustrates a Q-trap, Q-q-Q linear ion trap mass spectrometer system comprising auxiliary electrodes in accordance with an aspect of an embodiment of the present invention.

Referring to FIG. 1, there is illustrated in a schematic diagram, a QTRAP Q-q-Q linear ion trap mass spectrometer system 10 comprising auxiliary electrodes 12 in accordance with an aspect of an embodiment of the invention. During operation of the mass spectrometer, ions can be admitted into a vacuum chamber 14 through a skimmer 16. The linear ion trap 10 comprises four elongated sets of rods: Q0, a quadrupole mass spectrometer 16, a collision cell 18, and a linear ion trap 20, with orifice plates IQ1 after rod set Q0, IQ2 between quadrupole mass spectrometer 16 and collision cell 18, and IQ3 between collision cell 18 and linear ion trap 20. An additional set of stubby rods 21 is provided between orifice plate IQ1 and quadrupole mass spectrometer 16.

In some cases, fringing fields between neighboring pairs of rod sets may distort the flow of ions. Stubby rods 21 can be provided between orifice plate IQ1 and quadrupole mass spectrometer 16 to focus the flow of ions into the elongated rod set Q1.

Ions can be collisionally cooled in Q0, which may be maintained at a pressure of approximately $8\times10^{-3}$ torr. Quadrupole mass spectrometer 16 can operate as a conventional transmission RF/DC quadrupole mass spectrometer. In collision cell 18, ions can collide with a collision gas to be fragmented into products of lesser mass. Linear ion trap 20 can also be operated as a linear ion trap with or without mass selective axial ejection, more or less as described by Londry and Hager in the Journal of the American Association of Mass Spectrometry, 2003, 14, 1130-1147, and in U.S. Pat. No. 6,177,688, the contents of which are hereby incorporated by reference.

Ions can be trapped in linear ion trap 20 using radial RF voltages applied to the quadrupole rods and axial DC voltages applied to the end aperture lenses. In addition, as shown, linear ion trap 20 also comprises auxiliary electrodes 12.

As the ion population density increases within a quadrupole or a linear ion trap, space charge effects can reduce mass accuracy. Thus, the operation of linear ion trap mass spectrometers can be limited by the space charge or the total number of ions that can be analyzed without affecting the analytical performance of the trap in terms of either mass accuracy or resolution.

In accordance with an aspect of an embodiment of the invention, auxiliary electrodes 12 can be used within linear ion trap 20 to create octopole or non-linear RF and electrostatic fields in addition to the main RF quadrupole field provided by the quadrupole rod array of the linear ion trap 20. The anharmonicity of these fields can change the dynamics of the ion cloud inside the ion trap during the ejection process and can reduce the deleterious effects of self-induced space charge to improve mass accuracy. These auxiliary electrodes can be used in contexts different from those shown in FIG. 1, the set up of FIG. 1 being shown for illustrative purposes only. For example, such a non-linear ion trap could be used as a precursor ion selector in a tandem MS/MS system, such as a triple quadrupole, QqTOF or trap-TOF, as a product ion analyzer in a MS/MS configuration or as a stand alone mass spectrometer.

Figure 2:
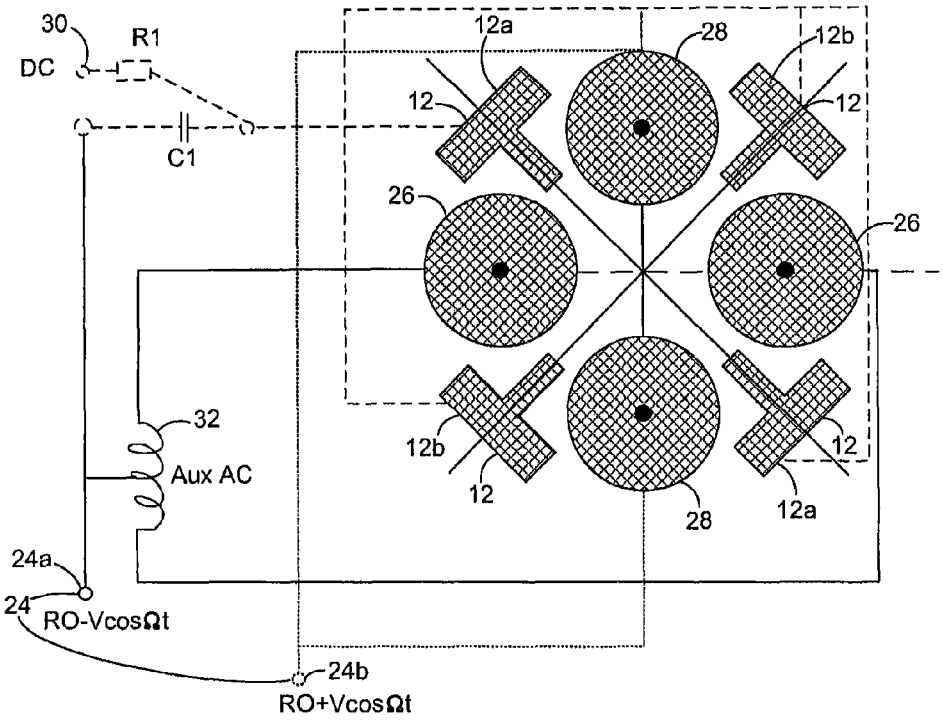
FIG. 2, in a schematic sectional view, illustrates the auxiliary electrodes and rods of a linear ion trap of a variant of the linear ion trap mass spectrometer system of FIG. 1.

FIG. 1 shows a possible axial position of the auxiliary electrodes 12 within the linear ion trap 20. Specifically, the auxiliary electrodes 12 lie within an extraction region of the linear ion trap 20. In some embodiments, such as the embodiment of FIG. 1, the extraction region extends over less than half the length of the linear ion trap 20. Referring to FIG. 2, the radial position of a particular variant of the auxiliary electrodes 12 relative to the linear ion trap 20 is shown. In the variant of FIG. 2, the auxiliary electrodes 12 are T-electrodes comprising a rectangular base section spaced from the central axis of the linear ion trap 20, and a rectangular top section extending toward the central axis of the linear ion trap 20 from the rectangular base section. As will be apparent to those of skill in the art, other electrode configurations could also be used. For example, without limitation, the rectangular top section of the T-electrodes might be retained, but some other means, other than the rectangular base section, could be used to mount this rectangular top section. Alternatively, the T-electrodes in their entirety could be replaced with cylindrical electrodes. In such an embodiment, the cylindrical electrodes would typically have smaller radii than the radii of the main rods 26, 28.

In the variant of FIG. 2, a main drive voltage supply 24 can supply a drive RF voltage, V cos Ωt, as shown. As it is known in the art, the voltage supply 24 can comprise a first RF voltage source for providing a first RF voltage, −V cos Ωt, to the first pair rods 26 at a first frequency Ω, and in the first phase, while the voltage supply 24 can also comprise a second RF voltage source operable to provide a second RF voltage, V cos Ωt, to the second pair of rods, again at the first frequency Ω, and opposite in phase to the first voltage applied to the first pair of rods 26.

As shown, the voltage supply 24 also provides a rod offset voltage RO to the rods, which can be equal for both the first pair of rods 26 and the second pair of rods 28. Typically, this rod offset voltage RO is a DC voltage opposite in polarity to the ions being confined within the linear ion trap.

As shown in FIG. 2, auxiliary electrodes 12 can be electrically coupled to each other, and also to the main voltage supply 24 via a capacitor C1 to step down the magnitude of the RF voltage supplied to the auxiliary electrodes 12 relative to the magnitude V, of the RF voltage supplied to the first pair of rods 26. Please note that in the variant of FIG. 2 the rod offset voltage from the main voltage source 24 is not provided to the auxiliary electrodes 12. Instead, a separate or independent power supply 30 is connected to the auxiliary electrodes 12 via resistor R1. As shown, the RF supplied to the auxiliary electrodes 12 by the main voltage supply 24 can be substantially in phase with the RF voltage provided to the first pair of rods 26, and can be substantially out of phase with the RF voltage provided to the second pair of rods 28. Again as shown in FIG. 2, a dipolar excitation AC voltage can be provided by, say, an auxiliary AC voltage source 32, to the first pair of rods to provide a dipolar excitation signal to provide axial ejection, as described, for example in U.S. Pat. No. 6,177,688. Optionally, the selected ions that are excited by the dipolar excitation signal can be axially ejected past an axial lens 34 to a detector 36 to generate a mass spectrum. Alternatively, these ions can be transmitted to downstream rod sets for further processing. For example, a further downstream rod set might be used to enhance resolution. Alternatively, the ions could be fragmented and analyzed in a downstream mass spectrometer. As is known in the art, the AC voltage provided by the auxiliary voltage source 32 can often be at a much lower frequency than the first frequency Ω.

Optionally, the auxiliary electrodes 12 need not be coupled to the main voltage supply 24. Instead, a separate or auxiliary RF voltage source or power supply could be incorporated into the mass spectrometer system 10 to provide the auxiliary RF voltage to the four auxiliary electrodes. In such an embodiment, the auxiliary RF voltage could be phase locked to the first RF voltage source 24*a* used to supply the first RF voltage to the first pair of rods 26. That is, the RF supplied to the auxiliary electrodes 12 by the above-mentioned auxiliary RF voltage source or power supply can be in phase with the RF voltage provided to the first pair of rods 26, but may also be out of phase with the RF voltage provided to the first pair of rods 26 by as much as plus or minus 1 degree, or even plus or minus 10 degrees. Further optionally, the dipolar excitation AC voltage can be provided to a diagonally oriented pair of auxiliary electrodes, which could be either of auxiliary electrode pairs 12*a* or 12*b*, instead of the first pair of rods to provide the dipolar excitation signal to provide axial ejection, as described, for example in U.S. Pat. No. 7,692,143. The diagonally oriented pair of auxiliary electrodes may be closer to the other auxiliary electrodes than each other and may be separated by the central axis of the quadrupole. One electrode in the diagonally oriented pair of auxiliary electrodes may be closer to and substantially between two adjacent rods 26 and 28, while the other auxiliary electrode in the diagonally oriented pair of auxiliary electrodes is closer to and substantially between the other two adjacent rods 26 and 28.

By providing the auxiliary electrodes 12 in the symmetrical configuration shown in FIG. 2 relative to the rods 26, 28, a two-dimensional substantially quadrupole field can be provided with a significant octopole component without adding significant magnitudes of other higher order components. Specifically, a two-dimensional substantially quadrupole field can be provided comprising a quadrupole harmonic of amplitude A2, and an octopole harmonic of amplitude A4, where A4 is greater than 0.01% of A2, and is less than 0.5% of A2. In some embodiments, A4 may actually be less than 0.1% of A2, or even less than 0.05% of A2. In particular modes of operation, maintaining A4 at 0.035% of A2 has been found to be advantageous.

At the same time, for any higher order harmonic with amplitude An, n being 3 or greater than 4, present in the field, A4 will typically be much greater than An. That is, A4 will typically be greater than 10 times An, and can be greater than 100 times An or even 1000 times An.

Symmetry

The relative purity of the field that can be generated, in that it is substantially limited to quadrupole and octopole components, arises at least partly as a consequence of the symmetry of the linear ion trap 20 in the extraction region comprising auxiliary electrodes 12. That is, as shown in FIG. 2, at any point along the central axis of the extraction region of a linear ion trap 20, shown in FIG. 1, an associated plane orthogonal to the central axis intersects the central axis, intersects the first pair of rods 26 at an associated first pair of cross sections (marked as 26 in FIG. 2) and intersects the second pair of rods 28 at an associated second pair of cross sections (marked as 28 in FIG. 2). This associated first pair of cross section 26 are substantially symmetrically distributed about the central axis and are bisected by a first axis lying in the associated plane orthogonal to the central axis and passing through a center of each cross section 26 in the first pair of cross sections 26. The associated second pair of cross sections 28 are substantially symmetrically distributed about the central axis and are bisected by a second axis lying in the associated plane orthogonal to the central axis and passing through a center of each cross section 28 in the second pair of cross sections 28. The first axis and the second axis are substantially orthogonal and intersect at the central axis.

At any point along the central axis in the extraction region, the associated plane orthogonal to the central axis intersects the first pair of auxiliary electrodes 12*a* at a first pair of auxiliary cross sections (marked 12*a* in FIG. 2) and intersects the second pair of auxiliary electrodes 12*b* at an associated second pair of auxiliary cross sections (designated 12*b* in FIG. 2). The associated first pair of auxiliary cross sections 12*a* are substantially symmetrically distributed about the central axis and are bisected by a third axis lying in the associated plane orthogonal to the central axis and passing through a centroid of each auxiliary cross section in the first pair of auxiliary cross sections 12*a*. The associated second pair of auxiliary cross sections 12*b* are substantially symmetrically distributed about the central axis and are bisected by a fourth axis lying in the associated plane orthogonal to the central axis and passing through a centroid of each auxiliary cross section 12*b* in the second pair of auxiliary cross sections 12*b*. Again, the third axis and the forth axis are substantially orthogonal, intersect at the central axis, and are offset by a substantially 45 degree angle from the first axis and the second axis.

Auxiliary Electrode Voltages

When a DC voltage provided to the auxiliary electrodes 12 by the independent power supply 30 is lower than the rod offset RO voltage, and when a barrier voltage applied to the exit lens 34 is higher than RO, ions can accumulate in the extraction region of the linear ion trap 20 containing the auxiliary electrodes 12. Once the ions have accumulated in the extraction region of the linear ion trap 20, collar electrodes (not shown) at the upstream end of the auxiliary electrodes, toward the middle of the linear ion trap 20, can be provided with a suitable barrier voltage for confining the ions within the extraction region, even if, as will be described below in more detail below, the DC voltage applied to the auxiliary electrodes is raised above the rod offset voltage.

Specifically, the DC field created by the auxiliary electrodes 12 can have a double action. First, as described above, this DC field can create an axial trap to attract, and to some extent, contain ions within the extraction region of the linear ion trap 20. In addition, the DC field created by the auxiliary electrodes can introduce radial octopole electrostatic fields that can change the dynamics of the ion cloud, radially. A strength of these fields can be varied by, for example, varying the voltage applied to the electrodes, or changing the depths of the rectangular top sections of the T-electrodes. Optionally, other approaches could also be used, such as by providing segmented auxiliary electrodes, the segments being configured to provide different voltages at different points along their length, or, say, by having the auxiliary electrodes diverge or converge relative to the central axis of the linear trap 20. Similarly, the strength of the non-linear RF fields introduced by the auxiliary electrodes 20 can be adjusted by changing the value of coupling capacitor C1 or changing or tapering the depth of the T-profile of the auxiliary electrodes 12. Preferably, the capacitive coupling C1 is adjustable to adjustably reduce the magnitude of the auxiliary RF voltage relative to the magnitude of the first RF voltage.

It can be desirable to have the capacitive coupling C1 be adjustable to permit the magnitude of the auxiliary RF voltage applied to the auxiliary electrodes 12 to be adjusted relative to the magnitude, V, of the RF voltages applied to the main rods. Specifically, it can be desirable to increase the proportion of RF provided to the auxiliary electrodes 12 as the scan speed is increased, although, in many embodiments, a higher magnitude of RF applied to the auxiliary electrodes 12 may also work for slower scan speeds.

In various embodiments, the amplitude of the DC voltage, provided to the auxiliary electrodes 12, can be selected to be in a pre-desired range corresponding to a particular mass range and/or mass ranges of ions to be ejected as well as scan rate of the mass selective axial ejection.

For example, when the rod offset voltage RO is −160V, the DC voltage applied to the auxiliary T-shaped electrodes 12 can be, at a scan rate of 1000 Da/s: −159V for an ion of mass-to-charge ratio 118 Da, −170V for 322 Da, −190V for 622 Da and −210V for 922 Da.

At a slower scan rate, of 250 Da/s, the DC voltage applied on the T-electrodes could be −162V for the 118 Da ion, −165V for 322 Da, −185V for 622 Da and −205V for the 922 Da ion.

Optionally, in addition to, or instead of, the amplitude of the DC voltage provided to the auxiliary electrodes 12 being adjusted, the auxiliary RF voltage provided to the auxiliary electrodes 12 can be adjusted, again depending upon the particular mass range and/or mass ranges of the ions to be ejected. In that case, in accordance with an aspect of an embodiment of the invention, a first group of ions of a first mass-to-charge ratio can be selected for axial ejection. After this first group of ions has been axially ejected, a second group of ions of different mass-to-charge ratio m/z can be selected for axial ejection. At least one of the DC voltage or auxiliary RF voltage provided to the auxiliary electrodes can then be adjusted to slide the measured m/z of that second group of ions toward the actual m/z of that second group of ions. This process can be continued for subsequent groups of ions. That is, different DC or auxiliary RF voltages can be provided to the auxiliary electrodes to obviate space charge density effects involving ions of different m/z.

Experimental Data

In both 3D and linear ion traps, the frequency of motion of ions in the quadrupole ion field can shift linearly downward as the ion number or density increases. In an ion trap mass spectra, this behavior can translate into a mass shift of the observed mass peaks toward higher masses with the increase in ion intensity. Moreover, peak width can also increase. This can be undesirable as it can lead to reduced mass accuracy, and also, due to the increase in peak width, reduced resolution.

Figure 3A:
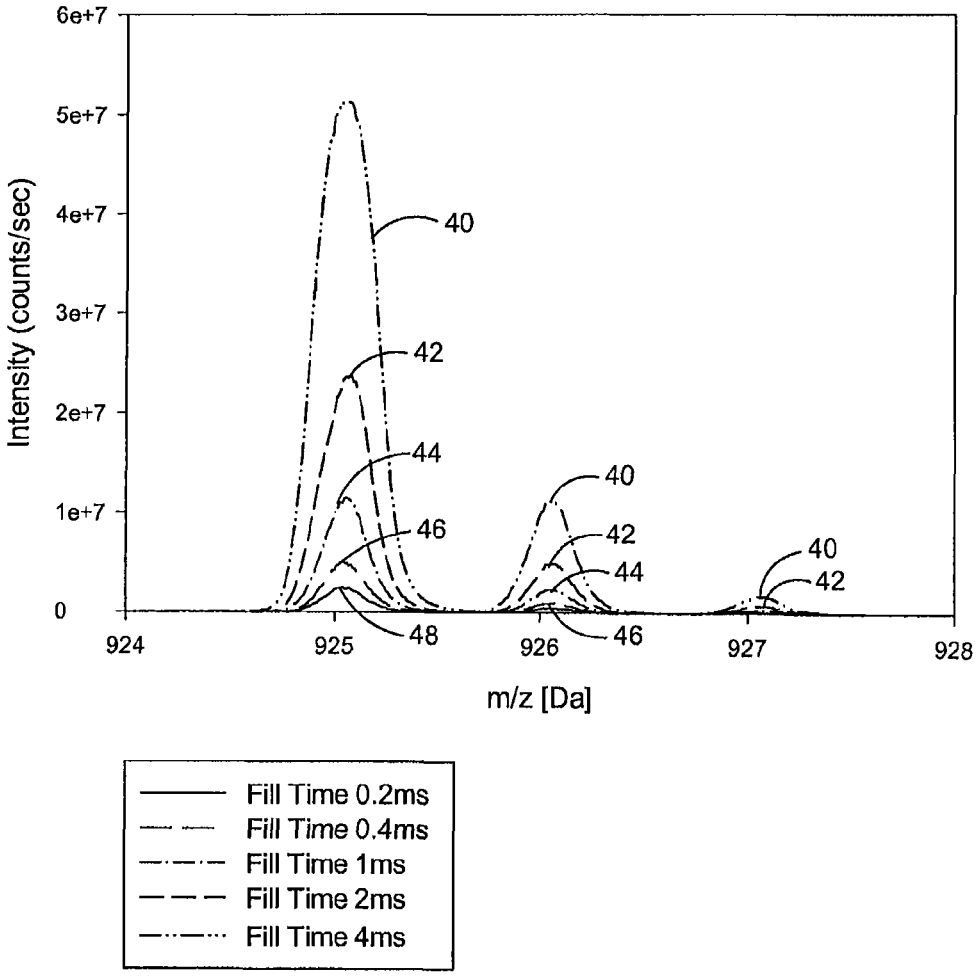
FIGS. 3*a* and 3*b* show the overlapped LIT spectra actual intensity (FIG. 3*a*) and relative intensity (FIG. 3*b*), respectively, when the fill time is varied from 0.2 ms to 4 ms.
Figure 3B:
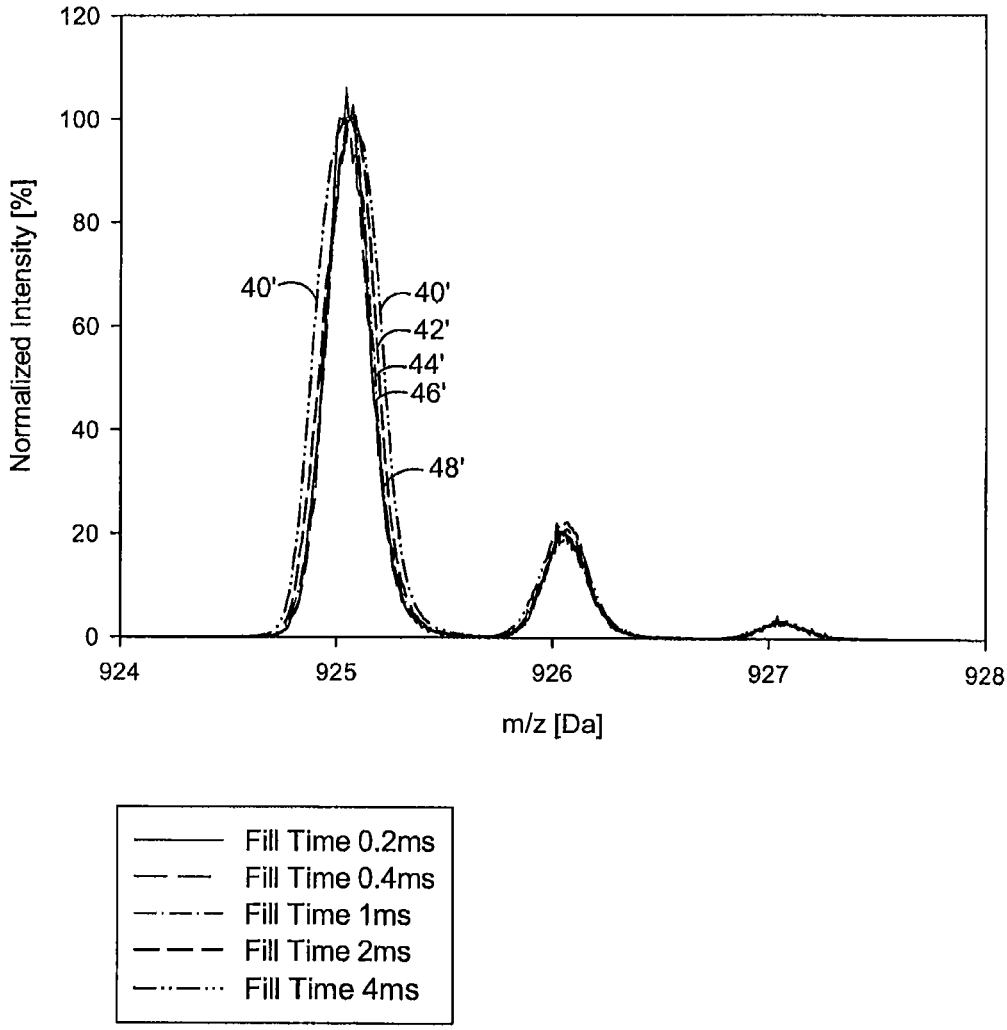

Referring to FIGS. 3*a* and 3*b*, linear ion trap spectra generated using the linear ion trap 20 of FIGS. 1 and 2 are shown. FIG. 3*a* plots the actual intensity of the ions, while FIG. 3*b* plots the relative intensity of the ions as the fill time is changed from 0.2 ms to 4 ms.

Specifically, referring to FIG. 3*a* spectrum 40 was generated using a fill time of 4 ms, spectrum 42 was generated using a fill time of 2 ms, spectrum 44 was generated using a fill time of 1 ms, spectrum 46 was generated using a fill time of 0.5 ms and spectrum 48 was generated using a fill time of 0.2 ms.

As can be seen from the overlapped spectra 40, 42, 44, 46 and 48, the position of the central peak along the X axis representing m/z is substantially unchanged. This is also illustrated by the relative intensity spectra shown in FIG. 3*b*, where spectrum 40' is for a fill time of 4 ms, spectrum 42' represents a fill time of 2 ms, spectrum 44' represents a fill time of 1 ms, spectrum 46' represents a time of 0.5 ms and spectrum 48' represents a fill time of 0.2 ms. Similar to FIG. 3*a*, FIG. 3*b* shows how use of the linear ion trap 20 of FIGS. 1 and 2, comprising auxiliary electrodes 12, can significantly reduce peak migration and thereby improve mass accuracy.

Figure 4A:
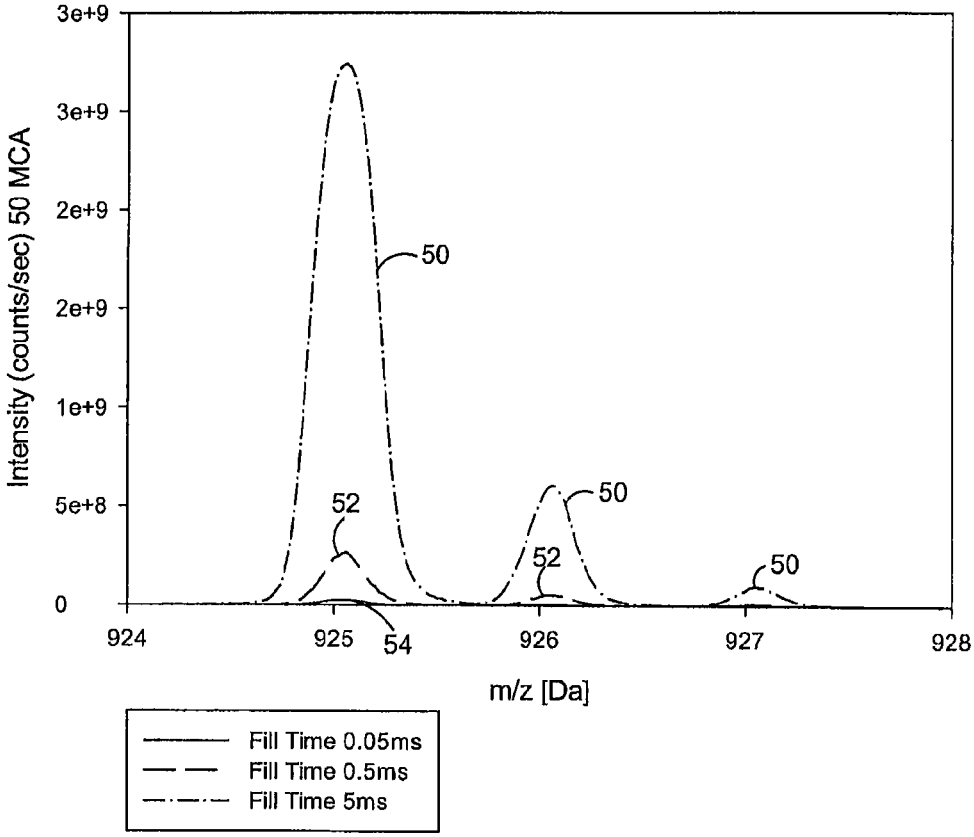
FIGS. 4*a* and 4*b* show the overlapped LIT spectra, actual intensity (FIG. 4*a*) and relative intensity (FIG. 4*b*) when the fill time is increased from 0.05 ms up to 5 ms.
Figure 4B:
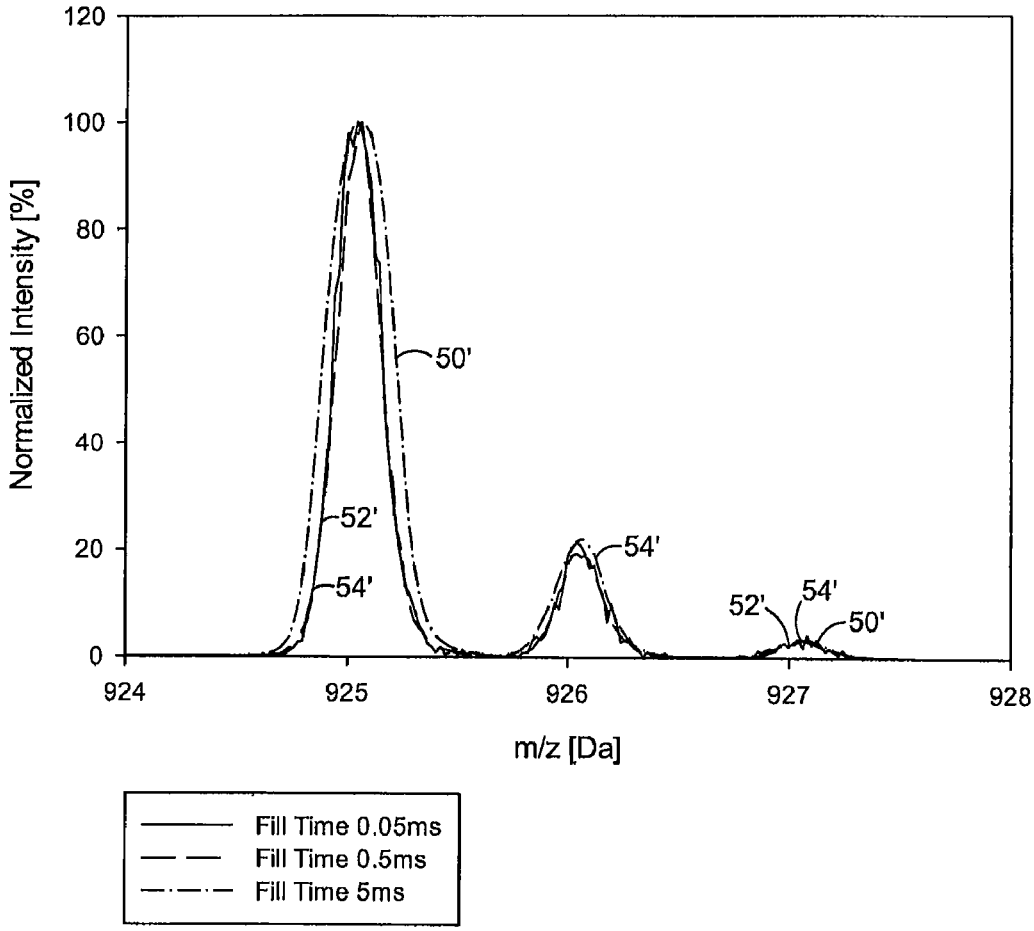

Referring to FIGS. 4*a* and 4*b*, additional linear ion trap spectra generated using the linear ion trap 20 of FIGS. 1 and 2 are shown. FIG. 4*a* plots the actual intensity of the ions, while FIG. 4*b* plots the relative intensity of the ions as the fill time is moved from 0.05 ms to 5 ms.

Referring back to FIG. 4*a*, spectrum 50 was generated using a fill time of 5 ms, spectrum 52 was generated using a fill time of 0.5 ms, and spectrum 54 was generated using a fill time of 0.05 ms. Due to the low ion intensities involved, spectrum 54 is only apparent in the leftmost peak of FIG. 4*a*.

As with the spectra of FIGS. 3*a* and 3*b*, from the overlapped spectra 50, 52 and 54, it can be seen that the position of the central peak along the X axis representing m/z is substantially unchanged when ion density or space charge is increased. This is also shown by the relative intensity spectra shown in FIG. 4*b*, where spectrum 50' represents a fill time of 5 ms, spectrum 52' represents a fill time of 0.5 ms and spectrum 54' represents a fill time of 0.05 ms. Accordingly, FIGS. 4*a* and 4*b* also show how use of the linear ion trap 20 of FIGS. 1 and 2 comprising auxiliary electrodes 12, can significantly eliminate peak migration even when fill times are increased 100 fold, and ion density increases proportionally.

Quadrupole rod sets configured to provide significant octopole components are previously known. However, the methods used to add these significant octopole components to substantially quadrupole fields in the past can also add significant other higher order components. In contrast, the linear ion trap 20 shown in FIGS. 1 and 2, comprising auxiliary electrodes 12, can be used to provide a substantially quadrupole field with a significant octopole component, without adding significant other higher order components. In the description that follows, this characteristic of the field produced, that it is substantially quadrupole with a higher order octopole component and little or no other higher order components is described as the purity of the field.

Specifically, by using linear ion trap 20 with auxiliary electrodes 12, a two dimensionally substantially quadrupole field can be established and maintained in the extraction region of the linear ion trap 20 to process ions. As described above, the field comprises a quadrupole harmonic of amplitude A2 and an octopole harmonic of amplitude A4. In many embodiments, A4 is greater than 0.01% of A2, while being less than 0.5% of A2. As described above, in some embodiments A4 may actually be less than 0.1% of A2 or even less than 0.05% of A2. Alternatively, in some embodiments A4 may merely be less than 1% or 5% of A2.

As a result of the particular approach used in adding the octopole component to the field, only minimal other higher order multiple components need be added. Thus, for any other higher order harmonic of amplitude An, higher order meaning higher order than a quadrupole harmonic with amplitude A2, n thus being any integer greater than 2 except for 4, A4 will be greater than 10 times An. In other words, the octopole component within the field will have an amplitude greater than 10 times the amplitude of the hexapole component, or any harmonic higher order than an octopole. In some embodiments A4 may be greater than 100 times the amplitude of the hexapole harmonic, or any other harmonic of higher order than the octopole, or A4 may be greater than 1000 times An.

This relatively pure field comprising, substantially, only a quadrupole component and a higher order octopole component, can be provided and maintained using the linear ion trap 20 comprising auxiliary electrodes 12. Specifically, as described above, a first RF voltage can be provided to the first pair of rods 26 at a first frequency and in a first phase, while a second RF voltage can be provided to the second pair of rods 28 at a second frequency and in a second phase. The second frequency can be equal to the first frequency, and the second phase can be opposite to the first phase. Concurrently, an auxiliary RF voltage can be provided to the four auxiliary electrodes 12 at an auxiliary frequency that is equal to the first frequency. The auxiliary RF voltage can also be in the first phase. A DC voltage can also be provided to the four auxiliary electrodes 12. This DC voltage applied to the four auxiliary electrodes 12 can be different than the DC offset voltage RO applied to the rods 26, 28.

Ions can be introduced into this field. Then, a selected portion of the ions within this field having a selected m/z can be axially transmitted and detected using the detector 36 downstream of the linear ion trap 20. Detecting the selected portion of the ions having the selected m/z can generate a sliding m/z measurement that does not necessarily correspond to the selected m/z depending on the ion density within the linear ion trap 20. By adjusting the DC voltage or auxiliary RF voltage provided to the four auxiliary electrodes, this sliding m/z can be changed or moved (hence "sliding") toward the actual selected m/z to take into account or obviate space charge problems. Given that a higher space charge density can increase the sliding m/z measured, as opposed to the actual selected m/z, the DC voltage or auxiliary RF voltage provided to the four auxiliary electrodes can be adjusted to slide the sliding m/z ratio measured downward toward the selected m/z.

Figure 5A:
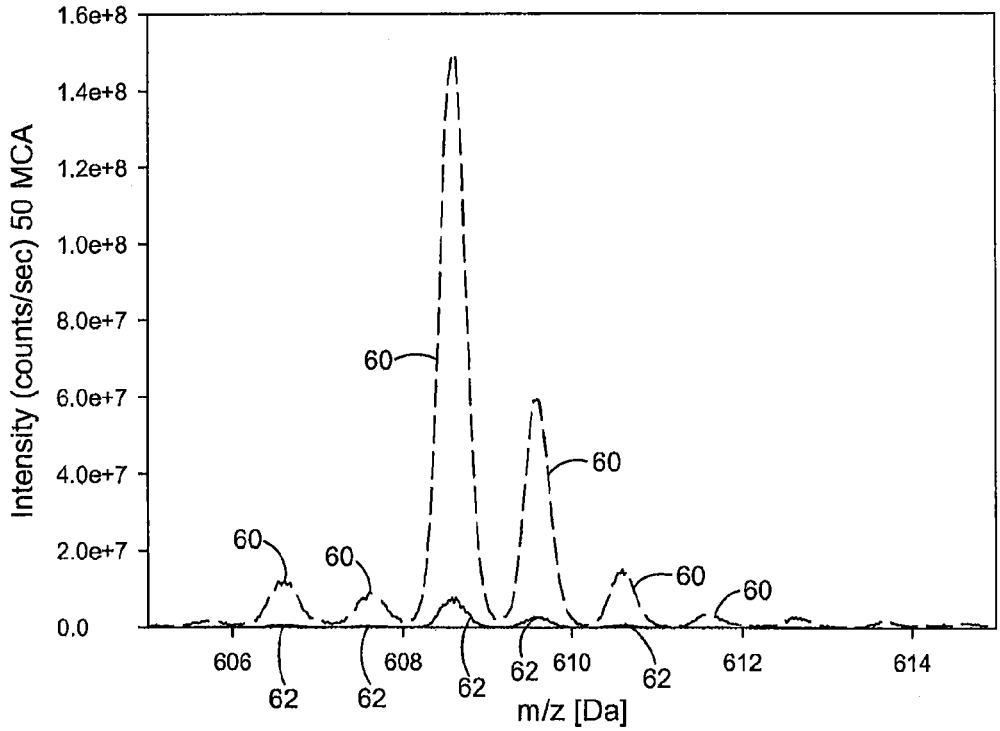
FIGS. 5*a* and 5*b* show the overlapped LIT spectra, actual intensity (FIG. 5*a*) and relative intensity (FIG. 5*b*) when ion population is increased twentyfold.
Figure 5B:
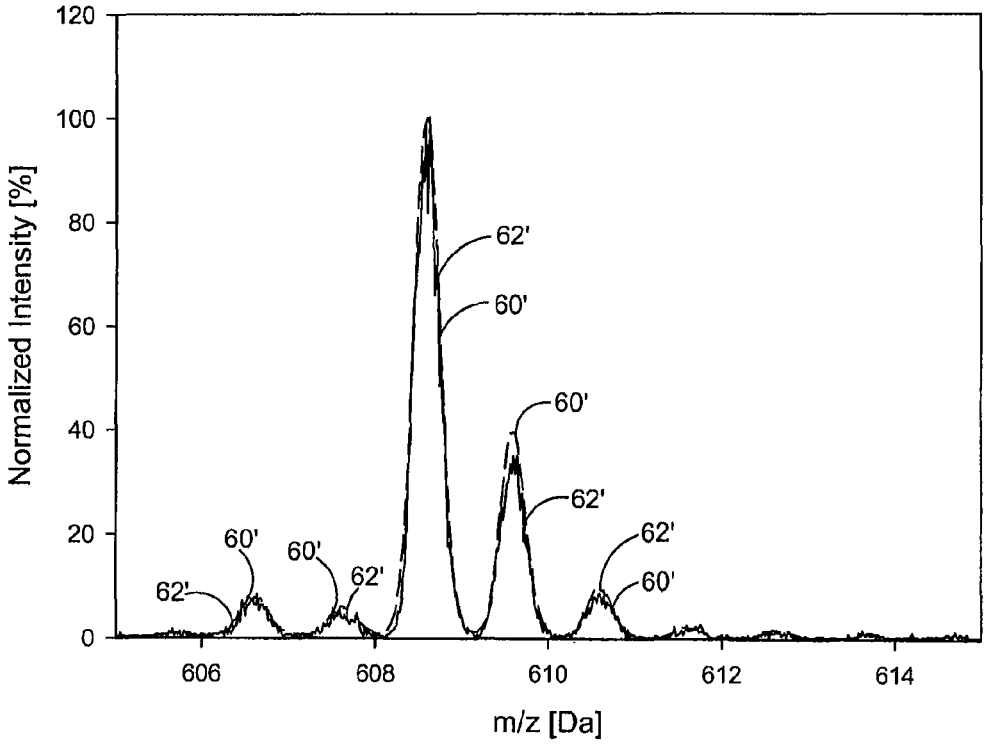

Referring to FIGS. 5*a* and 5*b*, linear ion trap spectra that can be generated using the linear ion trap 20 of FIGS. 1 and 2 are shown. FIG. 5*a* plots actual intensity of the ions, while FIG. 5*b* plots the relative intensity of the ions. The dashed line, spectrum 60, was generated for ions of selected mass to charge ratios. The mass spectrum 62 was generated for ions of the same selected mass to charge ratios. However, the ion population within the linear ion trap 20 was twenty times higher to generate the mass spectrum 60, as compared to the ion population within the linear ion trap 20 used to generate the ion trap spectrum 62. Accordingly, other things equal, one might have expected the space charge effects to induce some migration of the dashed line spectrum 60 to the right relative to the solid line spectrum 62. This does not appear to be the case in these linear ion trap spectra, however.

Specifically, as described above, prior to operating the linear ion trap 20 to generate the linear ion trap spectra of FIGS. 5*a* and 5*b*, the linear ion trap 20 can be calibrated by adjusting the amplitude of a DC voltage provided to the auxiliary electrodes 12 of the linear ion trap 20. Specifically, a selected portion of ions within the linear ion trap of known theoretic m/z can be selected and axially ejected to a detector to generate a mass spectrum. This measured mass spectrum can then be compared with the theoretic mass spectrum and the DC voltage or auxiliary RF voltage provided to the auxiliary electrodes 12 can be, for example, increased to, for example, shift the measured spectrum leftward along the X axis to align it with the theoretic spectrum. Once this is done, the DC voltage provided to the auxiliary electrodes 12 can be kept substantially constant to generate the linear ion trap spectra shown in FIGS. 5*a* and 5*b*. Of course, ions of widely different m/z could be sequentially axially ejected from linear ion trap 20. It may be desirable to use a number of different calibrant ions, including calibrant ions of mass-to-charge ratios reasonably close to the mass-to-charge ratio for each selected ion to be ejected. In this way, specific amplitudes of DC or auxiliary RF voltages suitable for addressing space charge density problems for different ions can be determined, at least approximately.

FIG. 5*a* plots the actual intensities of these ions, while FIG. 5*b* plots the relative intensity of the ions. Unlike the mass spectra of FIGS. 3*a*, 3*b*, 4*a* and 4*b*, in the mass spectra of FIGS. 5*a* and 5*b* some small peaks are formed to the left of the large or main peak. This is significant as linear ion traps are typically scanned from low mass to charge ratios to higher mass to charge ratios. Thus, at the time that these lower mass to charge ratio ions are axially transmitted from the linear ion trap, most of the ions will still be in a linear ion trap, and space charge effects will be, correspondingly, of greater significance. Notwithstanding this, as perhaps can best be seen in the relative mass intensity spectra of FIG. 5*b*, the linear ion trap spectrum 60' aligns with the linear ion trap spectrum 62' along all of the peaks, and in particular, along the two small peaks to the left of the large peak.

Once the DC voltage or auxiliary RF voltage provided to the four auxiliary electrodes has been adjusted to match the sliding m/z ratio with the actual or theoretic m/z ratio, then no further adjustments of DC voltage or auxiliary RF voltage may be required over a fairly large mass range. For example, an intermediate space charge density level could be provided in a linear ion trap of a selected ion having an actual or theoretic m/z. Then, the DC voltage or auxiliary RF voltage provided to the four auxiliary electrodes could be adjusted to slide the sliding m/z ratio measured downward towards the actual or theoretic m/z. Subsequently, as described below in connection with FIGS. 3 and 4, the linear ion trap, in different tests, may contain ions of the same m/z at a very low space charge density, as well as ions at a very high m/z space charge density. However, in both cases the detected or sliding m/z ratio actually measured can closely correspond to the actual or theoretic m/z, without further adjustment of the DC voltage or auxiliary RF voltage provided to the four auxiliary electrodes.

In some aspects of some embodiments, before axially transmitting a selected portion of the ions, the selected portion of the ions can be trapped in the extraction region of the linear ion trap 20 comprising the auxiliary electrodes 26, 28. At the downstream end of the extraction region, the selected portion of ions could be axially confined by a suitable barrier voltage provided to the exit lens, while at the upstream end of the extraction region, once the selected portion of ions are within the extraction region, they can be contained there and prevented from axially migrating back upstream out of the extraction region within the linear ion trap 20, by providing a suitable barrier voltage to, for example, collar electrodes (not shown) at the upstream end of the extraction region. To axially trap the selected portion of the ions in the extraction region, the RO provided to the first pair of rods 26 and the second pair of rods 28 can be maintained higher than the DC voltage provided to the four auxiliary electrodes, and a DC trapping voltage provided to the exit lens, can also be maintained higher than the rod offset. This selection of voltages can move the selected portion of the ions into the extraction region. Once the selected portion of the ions are within the extraction region, and the suitable barrier voltage is provided to the collar electrodes, the DC voltage provided to the four auxiliary electrodes can subsequently be varied, and can be even raised higher than the RO, as the collar electrodes can impede upstream movement of the selected portion of the ions out of the extraction region.

In some embodiments, the field can be varied along the length of the extraction region by changing a contribution to the field provided by the auxiliary RF voltage applied to the auxiliary electrodes, such that a ratio of A2 to A4 varies along the length of the four auxiliary electrodes 12. This can be done, for example, by 1) providing segmented auxiliary electrodes and applying a slightly different RF voltage to each of the segments of the auxiliary electrodes such that the RF itself varies; 2) by making the auxiliary electrodes T electrodes and then varying the rectangular top sections of these T electrodes; or 3) by having the auxiliary electrodes vary in terms of their distance from the central axis.

As shown in FIG. 2, a dipolar excitation AC voltage can be provided to the first pair of rods 26 by voltage source 32 to provide dipolar excitation to the selected portion of the ions. Typically, this dipolar excitation AC voltage will be at much lower frequencies than the other RF voltages provided to the rods in the auxiliary electrodes. This radial excitement of the selected portion of the ions can facilitate axial ejection of the ions, as described, for example, by Hager in U.S. Pat. No. 6,177,688.

Using a dipolar auxiliary signal, ions can be excited at their fundamental secular frequency $\omega_0=\beta\Omega/2$ where $\Omega$ is the angular frequency of the RF drive and $\beta$ is a function of the Mathieu stability parameters a and q. When the voltage applied the poles A and B is $RO+U-V\cos\Omega t$ and $RO-(U-V\cos\Omega t)$, respectively, the parameters a and q are given by $a=4zU/(4\,m\,\Omega^2 r_0^2)$ $q=2zV/(4\,m\,\Omega^2 r_0^2)$ where U is a direct voltage and V is the zero to peak amplitude of a sinusoidal voltage of angular frequency $\Omega$. While many of the above-described experiments were performed when a=0, i.e. U=0, it has also been observed experimentally that the improvements in space charge tolerance were also present when the linear ion trap was operated at a>0.

Other variations and modification of different embodiments of the invention are possible. For example, the auxiliary electrodes may extend axially beyond the ejection end of the first pair of rods 26 and the second pair of rods 28. Alternatively, the four auxiliary electrodes 12 may end short of the ejection end of the first pair of rods 26 and the second pair of rods 28. In other embodiments of the invention, the selected portion of the ions can be axially ejected from the linear ion trap 20 to a downstream rod set, which can be used to transmit the selected portion of the ions further downstream at a higher resolution. All such modifications or variations are believed to be within the sphere and scope of the invention as defined by the claims appended hereto.

The invention claimed is:

1. A method of processing ions in a linear ion trap, the method comprising a linear ion trap comprising a first pair of rods, a second pair of rods and four auxiliary electrodes interposed between the first pair of rods and the second pair of rods, establishing and maintaining the field comprises providing i) a first RF voltage to the first pair of rods at a first frequency and in a first phase, ii) a second RF voltage to the second pair of rods at a second frequency equal to the first frequency and in a second phase, opposite to the first phase, and iii) an auxiliary RF voltage to the four auxiliary electrodes at an auxiliary frequency equal to the first frequency and substantially in the first phase, iv) a DC voltage to the four auxiliary electrodes;

a) establishing and maintaining a two-dimensional substantially quadrupole field in a linear ion trap comprising a first pair of rods, a second pair of rods and four auxiliary electrodes interposed between the first pair of rods and the second pair of rods, the field comprising a quadrupole harmonic of amplitude A2 and an octopole harmonic of amplitude A4, wherein A4 is greater than 0.01% of A2, A4 is less than 5% of A2, and, for any other higher order harmonic with amplitude An present in the field, n being any integer greater than 2 except 4, A4 is greater than ten times An, wherein establishing and maintaining the field comprises providing i) a first RF voltage to the first pair of rods at a first frequency and in a first phase, ii) a second RF voltage to the second pair of rods at a second frequency equal to the first frequency and in a second phase, opposite to the first phase, iii) an auxiliary RF voltage to the four auxiliary electrodes at an auxiliary frequency equal to the first frequency and substantially in the first phase, and iv) a DC voltage to the four auxiliary electrodes; and, b) introducing ions to the field.

2. The method as defined in claim 1 wherein, for any higher order harmonic with amplitude An present in the field, A4 is greater than one hundred times An.

3. The method as defined in claim 1 wherein, for any higher order harmonic with amplitude An present in the field, A4 is greater than one thousand times An.

4. The method as defined in claim 3 further comprising axially transmitting a selected portion of the ions from the field, the selected portion of the ions having a selected m/z;

detecting the selected portion of the ions to provide a sliding mass signal peak centred about a sliding m/z ratio and adjusting at least one of the auxiliary RF voltage and the DC voltage provided to the four auxiliary electrodes to slide the sliding m/z ratio toward the selected m/z.

5. The method as defined in claim 4 wherein at least one of the auxiliary RF voltage and the DC voltage provided to the four auxiliary electrodes is adjusted to slide the sliding m/z ratio downward toward the selected m/z.

6. The method as defined in claim 4 wherein the linear ion trap system further comprises an exit lens, and the four auxiliary electrodes are interposed between the first pair of rods and the second pair of rods in an extraction region defined along at least part of a length of the four rods, the method further comprising axially trapping the selected portion of the ions in the extraction region before axially transmitting the selected portion of the ions.

7. The method as defined in claim 5 wherein axially trapping the selected portion of the ions in the extraction region before axially transmitting the selected portion of the ions comprises providing a rod offset voltage to the first pair of rods and the second pair of rods, the rod offset voltage being higher than the DC voltage provided to the four auxiliary electrodes; and, providing a DC trapping voltage applied to the exit lens, wherein the rod offset voltage is lower than the DC trapping voltage applied to the exit lens.

8. The method as defined in claim 4 wherein the linear ion trap system further comprises an ejection end of the first pair of rods, the second pair of rods and the four auxiliary electrodes, the method further comprising changing a contribution to the field provided by the auxiliary RF voltage such that a ratio of A2 to A4 varies along a length of the four auxiliary electrodes.

9. The method as defined in claim 4 wherein axially transmitting the selected portion of the ions having the selected m/z from the field, comprises providing a dipolar excitation AC voltage to the first pair of rods or a diagonally oriented pair of auxiliary electrodes at a lower frequency than the first frequency to radially excite the selected portion of the ions having the selected m/z, wherein the diagonally oriented pair of auxiliary electrodes are closer to the other auxiliary electrodes than to each other.

10. The method as defined in claim 1 wherein the auxiliary RF voltage is within ten degrees of the first phase.

11. The method as defined in claim 1 wherein the auxiliary RF voltage is within one degree of the first phase.

12. The method as defined in claim 5, further comprising after axially transmitting the selected portion of the ions having the selected m/z from the field axially transmitting a second selected portion of the ions from the field, the second selected portion of the ions having a second selected m/z;

detecting a second selected portion of the ions to provide a second sliding mass signal peak centered about a second sliding m/z ration; and, adjusting at least one of the auxiliary RF voltage and the DC voltage provided to the four auxiliary electrodes to slide the second sliding m/z ratio toward the second selected m/z.

13. The method of claim 1 wherein A4 is less than 0.1% of A2.

14. A linear ion trap system comprising:

a central axis;

a first pair of rods, wherein each rod in the first pair of rods is spaced from and extends alongside the central axis;

a second pair of rods, wherein each rod in the second pair of rods is spaced from and extends alongside the central axis;

four auxiliary electrodes interposed between the first pair of rods and the second pair of rods in an extraction region defined along at least part of a length of the first pair of rods and the second pair of rods, wherein the four auxiliary electrodes comprise a first pair of auxiliary electrodes and a second pair of auxiliary electrodes; and, a voltage supply connected to the first pair of rods, the second pair of rods and the four auxiliary electrodes, wherein the RF voltage supply is operable to provide i) a first RF voltage to the first pair of rods at a first frequency and in a first phase, ii) a dipolar excitation AC to either the first pair of rods or a diagonally oriented pair of auxiliary electrodes at a lower frequency than the first frequency to radially excite the selected portion of the ions having the selected m/z, iii) a second RF voltage to the second pair of rods at a second frequency equal to the first frequency and in a second phase, opposite to the first phase, and iv) an auxiliary RF voltage to the four auxiliary electrodes at an auxiliary frequency equal to the first frequency and substantially in the first phase, wherein the diagonally oriented pair of auxiliary electrodes are closer to the other auxiliary electrodes than to each other.

15. The linear ion trap system as defined in claim 14, further comprising a detector positioned to detect ions axially ejected from the rod set and the auxiliary electrodes.

16. The linear ion trap system as defined in claim 14, wherein the voltage supply comprises a first RF voltage source operable to provide the first RF voltage to the first pair of rods and the auxiliary RF voltage to the four auxiliary electrodes; and, a capacitive coupling for connecting the four auxiliary electrodes to the first RF voltage source to reduce a magnitude of the auxiliary RF voltage relative to a magnitude of the first RF voltage.

17. The linear ion trap system as defined in claim 16, wherein the capacitive coupling is adjustable to adjustably reduce the magnitude of the auxiliary RF voltage relative to the magnitude of the first RF voltage.

18. The linear ion trap system as defined in claim 14, wherein the RF voltage source comprises a first RF voltage source operable to provide the first RF voltage to the first pair of rods; an auxiliary RF voltage source operable to provide the auxiliary RF voltage to the four auxiliary electrodes, the auxiliary RF voltage source being phase-locked to the first RF voltage source.

19. The linear ion trap system as defined in claim 14 further comprising a DC voltage source connected to the auxiliary electrodes, the DC voltage source being adjustable to vary the DC voltage provided to the four auxiliary electrodes.

20. The linear ion trap system as defined in claim 14 wherein the auxiliary RF voltage is within ten degrees of the first phase.

21. The linear ion trap system as defined in claim 14 wherein the auxiliary RF voltage is within one degree of the first phase.

22. The linear ion trap system as defined in claim 14, wherein the extraction portion of the central axis comprises less than half the central axis.

23. The linear ion trap system as defined in claim 14, wherein the extraction region comprises an ejection end of the first pair of rods and the second pair of rods, and wherein the four auxiliary electrodes extend axially beyond the ejection end of the first pair of rods and the second pair of rods.

24. The linear ion trap system as defined in claim 14, wherein the extraction region comprises an ejection end of the first pair of rods and the second pair of rods, and wherein the four auxiliary electrodes end short of the ejection end of the first pair of rods and the second pair of rods.

25. The linear ion trap system as defined in claim 14, wherein, at any point along the central axis, an associated plane orthogonal to the central axis intersects the central axis, intersects the first pair of rods at an associated first pair of cross sections, and intersects the second pair of rods at an associated second pair of cross sections;

the associated first pair of cross sections are substantially symmetrically distributed about the central axis and are bisected by a first axis lying in the associated plane orthogonal to the central axis and passing through a center of each cross section in the first pair of cross sections;

the associated second pair of cross sections are substantially symmetrically distributed about the central axis and are bisected by a second axis lying in the associated plane orthogonal to the central axis and passing through a center of each cross section in the second pair of cross sections; and, the first axis and the second axis are substantially orthogonal and intersect at the central axis; and, wherein, at any point along the central axis in an extraction portion of the central axis lying within the extraction region, the associated plane orthogonal to the central axis intersects the first pair of auxiliary electrodes at a first pair of auxiliary cross sections, and intersects the second pair of auxiliary electrodes at an associated second pair of auxiliary cross sections;

the associated first pair of auxiliary cross sections are substantially symmetrically distributed about the central axis and are bisected by a third axis lying in the associated plane orthogonal to the central axis and passing through a centroid of each auxiliary cross section in the first pair of auxiliary cross sections;

the associated second pair of auxiliary cross sections are substantially symmetrically distributed about the central axis and are bisected by a fourth axis lying in the associated plane orthogonal to the central axis and passing through a centroid of each auxiliary cross section in the second pair of auxiliary cross sections; and the third axis and the fourth axis are substantially orthogonal, intersect at the central axis; and are offset by a substantially 45 degree angle from the first axis and the second axis.

26. The linear ion trap system as defined in claim 25, wherein each cross section in the first pair of auxiliary cross sections and second pair of auxiliary cross sections are substantially T-shaped, comprising a rectangular base section connected to a rectangular top section.

27. The linear ion trap system as defined in claim 26, wherein the extraction region comprises an ejection end of the first pair of rods, the second pair of rods and the four auxiliary electrodes, and each rectangular top section in the first pair of auxiliary cross sections and the second pair of auxiliary cross sections tapers along the length of the four auxiliary electrodes.

* * * * *